United States Patent [19]

Moran

[11] 4,276,089

[45] Jun. 30, 1981

[54] ANTICORROSION COMPOSITION

[75] Inventor: Francis Moran, Paris, France

[73] Assignee: Union Chimique et Industrielle de l'Ouest S.A., Paris, France

[21] Appl. No.: 83,553

[22] Filed: Oct. 10, 1979

[30] Foreign Application Priority Data

Oct. 13, 1978 [FR] France ..... 78 29312
Jun. 28, 1979 [FR] France ..... 79 16763

[51] Int. Cl.[3] ..... C02F 5/12

[52] U.S. Cl. ..... 106/14.12; 106/14.18; 252/181; 252/389 A; 252/390; 422/15; 422/16

[58] Field of Search ..... 106/14.12, 14.18; 252/175, 180, 181, 389 A, 390; 422/15, 16

[56] References Cited

U.S. PATENT DOCUMENTS

| | | | |
|---|---|---|---|
| 2,771,417 | 11/1956 | Ryznar et al. | 422/16 |
| 2,857,333 | 10/1958 | Thompson | 252/389 |
| 3,069,225 | 12/1962 | Anderson | 422/7 |
| 3,505,238 | 4/1970 | Liddell | 252/180 |
| 3,671,448 | 6/1972 | Kowalski | 252/180 |
| 3,723,333 | 3/1973 | von Freyhold | 252/180 |

FOREIGN PATENT DOCUMENTS 1435020 3/1966 France .

*Primary Examiner*—Lorenzo B. Hayes
*Attorney, Agent, or Firm*—Shenier & O'Connor

[57] ABSTRACT

The present invention relates to an anti-corrosion composition, which contains:

(a) at least a polyamine with a molecular weight greater than or equal to 320 and answering to the general formula:

$$R—[NH—(CH_2)_3]_{n1}—NH_2$$

wherein R is a saturated or unsaturated aliphatic $C_{12}$–$C_{22}$ hydrocarbon radical; and $n_1$ is an integer varying between 1 and 7 inclusive, R and $n_1$ being such that the molecular weight of the said polyamine is greater than or equal to 320; and (b) at least one alkylenephosphonic acid derivative selected from the group constituted by the aminoalkylenephosphonic acids derivatives and the alkylenepolyphosphonic acid derivatives.

The invention further relates to the method for preparing the said composition.

Said composition is useful to inhibit the corrosion of metallic surfaces caused by water, in liquid or steam form.

8 Claims, No Drawings

ANTICORROSION COMPOSITION

The present invention relates to an anti-corrosion composition as a new industrial product. It further relates to the method for preparing said composition and to its application in the protection of metallic surfaces, and in particular against corrosion caused by water in liquid or steam form.

It is known that any metallic surfaces normally used in industry, and any equipment composed of one or more metals, such as iron and its alloys, galvanized steel especially, copper and its alloys, to quote but the ones mostly used, are subjected, when in contact with water, to disturbing alterations, known as "corrosion phenomena".

It is also known that the differences existing between the respective dissolution potentials of the various metals, when in contact with water, lead to the formation of electrochemical couplings which further aggravate the phenomena of preferential deterioration of certain metals with respect to others. Said corrosion phenomena are all the more important and cumulative that the supplies of new water are frequent or in large quantities. And a fact which is currently observed is that, by improving from a productivitiy standpoint, industrial materials become both more expensive and more sensitive to different corrosions.

Finally, it is known that due to increasing needs in waters of different qualities, the characteristics of said waters are seen to vary rather noticeably, at sometimes very short intervals, particularly as regards their contents in dissolved or combined gases, or in corrosive salts, or in salts that may be precipitated in embedded forms. The prior physico-chemical treatment of waters only very rarely excludes the necessary use of a treatment or "conditioning" with anti-corrosion agents introduced in the pre-treated water, with a view to ensuring an artificial protection of most metals used in installations. Such conditionings may be done with many mineral substances such as phosphates, polyphosphates, chromates, silicates, nitrites, sulfites, etc., or with organic ones, such as thiols, thiazols, amines, tannins, etc.; and selected as a function of the characteristics of the water used and of the installations proper. However, most of these substances, if taken separately, have not a large enough anti-corrosion effect and should in most cases be either used in combination with one another, or in individually varying quantities, thereby requiring expensive care from a highly qualified staff. All the foregoing contributes to the complexity and to the unreliability of the protection methods in heating, air-conditioning, cooling or energy-producing installations found in industries or in private buildings.

Amongst the organic or organo-mineral substances most used today, and having anti-corrosion properties, are found for example amines phosphorous derivatives, as well as amines proper. Amongst phosphorous derivatives recommended as anti-corrosion agents are aminophosphonic acids and their water-soluble salts described in French Pat. Nos. 1,430,798, 1,453,022, 1,461,087, and 1,474,068 and in published French Applications Nos. 2,060,416, 2,144,900, 2,148,260, 2,174,091, 2,184,939, 2,184,940 and 2,259,105. Without actually explaining the protective action mechanism of these substance, the said documents give the specific conditions in which the said aminophosphonic acids should be stoichiometrically neutralized with mineral or organic bases, and should be associated with salts that are soluble in water containing polyvalent metallic cations, such as certain zinc or chromium salts, and associated with certain organic inhibitors containing sulphur. It should however be noted that the aminophosphonic acids described previously are still presented and used in the form of water-soluble compounds to produce effects reducing the corrosion of metals to a loss of thickness always greater than or equal to 100μ/ann., at a dose of 5 ppm, and particularly with ferrous metals.

It is known that amines have also been proposed as anti-corrosion agents, which have a molecular weight less than 300; these are ammonia, hydrazine, alkylamines (and in particular in $C_1$–$C_4$), morpholine, benzylamine, cyclohexylamine, alkanolamines (see for example published French Patent Application No. 2,310,420) and polyalkylenepolyamines (see for example U.S. Pat. Nos. 3,069,225 and 2,857,333 and Dutch Pat. No. 100,963), and their water-soluble salts obtained in particular by stoichiometric neutralization by means of the aminophosphonic acids described in the aforesaid documents, or by means of polyphosphonic acids. Said amines and their phosphonates lead to an insufficient inhibition of metal corrosion due especially to water, and this because the loss of thickness of the metallic surfaces requiring protection is of the order of 80 to 150μ/ann. in the best conditions of use.

It is also known that the use of fatty alkylamines in $C_{12}$–$C_{22}$ has been recommended and in particular that of dehydroabietylamine, larylamine, and stearylamine and their acid addition salts with HCl and $CH_3COOH$, as well as of aliphatic polyamines with long chains known as "fatty polyamines" (see French Pat. No. 1,435,023), such as stearylaminopropyleneamine. The disadvantage with these fatty alkylamines and polyamines is that they give an inadequate inhibition against corrosion produced by water, since the loss of thickness of the metallic surfaces (and particularly Fe or Cu surfaces) is of the order of 80 to 100μ/ann. in the best conditions of use.

In short, the inhibitors of the prior art and their salts lead at the most to a loss of thickness of between 80 and 150μ/ann.

It is the object of the present invention to propose a new technical solution to solve the problem of corrosion inhibition in metallic surfaces, which solution differs from that proposed in the prior art.

Another object of the invention is to propose a new anti-corrosion composition with an anti-corrosion power greater than that of the means recommended before. Indeed, in a large number of cases, the rates of residual corrosion through water (loss of thickness between 80 and 150μ/ann.) are still judged to be too high considering the repair and maintenance costs of the installations and considering the production or operation stoppages often necessitated by such repairs or by replacements. For example, compared with the solution proposed in published French Patent Application No. 2,310,420 which consists in using a water-soluble anti-corrosion composition comprising (i) a mixture of alkanolamines and (ii) a phosphonic acid derivative (and in particular 1-hydroxyethylidene-1,1-disphosphonic acid or aminomethylenetriphosphonic acid), the technical solution according to the invention leads to better results: the rates of corrosion through city water, according to the invention, expressed in percentages with respect to controls are, for steel, lower than those given in French application No. 2,310,420, as can be seen when comparing the Tables II to IX hereinafter with Tables II to IV of the said French Application.

Therefore, in order to overcome the disadvantages of the prior art, the present invention proposes a new anti-corrosion composition containing at least a polyamine and at least an alkylenephosphonic acid derivative, with which composition it is possible to reach, for metal surfaces needing to be protected from water for example, losses of thickness below, or equal to 50μ/ann.

It was unexpectedly found that when mixing special polyamines with alkylenephosphonic acid derivatives (selected from the derivatives of aminoalkylenephosphonic acid and of alkylenepolyphosphonic acid) in non-stoichiometric ratios, a composition is obtained which is insoluble in water but has anti-corrosion properties which, when measured in identical conditions, are greater than those of water-soluble phosphonic acids used on their own or, in the salt form, with amines, and greater than those of polyamines used on their own or in their water-soluble form. It was even more unexpected to find that the more the mixture of a polyamine with an alkylenephosphonic acid derivatives is insoluble in water, the better the anti-corrosion effect.

By "aminoalkylenephosphonic acid derivatives" are meant here acids, salts and esters with, in their molecule, at least a fragment

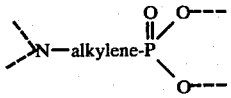

(wherein the alkylene group has a straight or branched hydrocarbon chain, and the dotted lines are bonds with other groups) as indicated in French Pat. No. 1,430,798.

By "alkylenepolyphosphonic acid derivative" is meant here a compound with at least two phosphonic functions and which is particularly selected from the group constituted by the alkylenepolyphosphonic acids, their esters and their mineral salts (such as for example metallic salts and $NH_4^+$), the alkylene chain containing no amino group.

The anti-corrosion composition according to the invention which comprises at least a polyamine and at least an alkylene-phosphonic acid derivative is a water-insoluble composition containing;

(a) at least a polyamine with a molecular weight greater than or equal to 320 and answering to the general formula $$R—[NH—(CH_2)_3]_{n1}—NH_2 \quad (I)$$

wherein R is a saturated or unsaturated aliphatic $C_{12}$–$C_{22}$ hydrocarbon radical; and $n_1$ is an integer varying between 1 and 7 inclusive, R and $n_1$ being such that the molecular weight of the said polyamine is greater than or equal to 320; and (b) at least one alkylenephosphonic acid derivative such as defined hereinabove.

Amongst suitable polyamines of formula I, can be mentioned dodecyltri(aminopropylene)amine, dodecyltetra(aminopropylene)amine, hexadecyltri(aminopropylene)amine, hexadecenyltetra(aminopropylene)amine, octadecylaminopropyleneamine, octadecylpenta(aminopropylene)amine, octadecenyltetra(aminopropylene)amine, octadecyltri(aminopropylene)amine, octadecenylhexa(aminopropylene)amine, and hexadecylhepta(aminopropylene)amine.

The amines of formula I may be used such as they are found in the trade, either on their own or mixed together, in their pure or technical form. It is also possible to use polyamines prepared from fatty acids of animal or vegetable origin or polyamines of synthesis. Amongst suitable polyamines, found on the market are the products known under the trademarks DIOMEEN, DINORAM, TRINORAM, POLYRAM, LILAMIN and CEMULCAT, which contain at least a polyamine I, with a molecular weight greater than or equal to 320.

Amongst the suitable aminoalkylenephosphonic acid derivatives according to the invention, the following can be mentioned and their alkyl esters in $C_1$–$C_4$ (fatty acids being the preferred derivatives), namely:

acids of formula

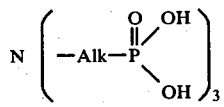

(II)

wherein Alk is an alkylene group in $C_1$–$C_6$ with a straight or branched hydrocarbon chain, acids of formula $$(H_2O_3P—CH_2)_2N—(CH_2)_{n2}—N(CH_2—PO_3H_2)_2 \quad (III)$$

wherein $n_2$ is an integer varying between 1 and 6 inclusive;

di(hydroxyethyl)aminomethylphosphonic acid of formula $$(HOCH_2CH_2)_2N—CH_2—PO_3H_2 \quad (IV)$$

acids of formula $$Z^1—O—(Z^2—O)_{n3}—Z^3—N[(CH_2)_{n4}—PO_3H_2]_2 \quad (V)$$

wherein $Z^1$ is H or an alkyl group in $C_1$–$C_5$; $Z^2$ is an alkylene group in $C_2$–$C_5$; $Z^3$ is an alkylene group in $C_3$–$C_5$; $n_3$ is an integer varying between 1 and 20 inclusive, and $n_4$ is an integer varying between 1 and 4.

Amongst acids of formula II, the following can be mentioned by way of example and non-restrictively: aminotri(methylphosphonic)acid, aminotri(ethylphosphonic)acid, aminotri(butylphosphonic)acid, aminotri[(α,α-dimethyl)methylphosphonic]acid.

Amongst acids of formula III, the following can be cited by way of example and non-restrictively, ethylenediaminotetra(methylphosphonic)acid, propylenediaminotetra(methylphosphonic)acid.

Amongst acids of formula V, the following can be cited by way of example and non-restrictively, diethoxypropylaminodi(methylphosphonic)acid, undecaethoxypropylaminodi(ethylphosphonic)acid and pentapropoxypropylaminodi(methylphosphonic)acid.

Amongst the suitable alkylenepolyphosphonic acid derivatives are for example the acids, esters and salts represented by the formula

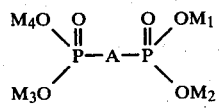

(VI)

A is a bivalent alkylene group comprising a straight and saturated $C_1$–$C_{10}$ hydrocarbon chain, each carbon atom of which chain can be, if necessary, substituted by at least a group selected from the OH, $C_1$–$C_4$-alkyl and phosphonic groups

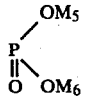

and $M_1$, $M_2$, $M_3$, $M_4$, $M_5$ and $M_6$, whether identical or different are each H, an alkyl group in $C_1$–$C_4$, $NH_4^+$ or a metal cation.

Amongst the suitable groups A are the $-(CH_2)_m$ [wherein m is an integer with a value varying between 1 and 10],

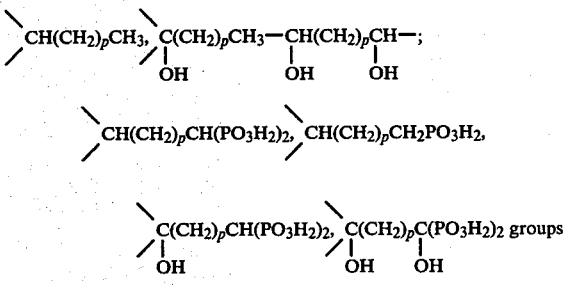

wherein p is an integer with a value varying between 0 and 8. Other suitable groups A are given hereinafter.

Amongst the mineral salts included in the definition of formula VI, the preferred ones are the salts $NH_4^+$ and salts of monovalent metals such as alkaline metals Na and K.

The most advantageous amongst the products of formula VI are alkylenepolyphosphonic acids ($M_1=M_2=M_3=M_4=M_5=M_6=H$), in particular alkylenediphosphonic, alkylenetriphosphonic and alkylenetetraphosphonic acids. And amongst these are methylene-1,1-diphosphonic[$A=CH_2$], trimethylene-1,3-diphosphonic[$A=(CH_2)_3$], 1-hydroxyethylidene-1,1-diphosponic[$A=>C(OH)CH_3$], isopropylidene-diphosphonic[$A=>C(CH_3)_2$], 1-hydroxybutylidene-1,1-disphosphonic[$A=>C(OH)CH_2CH_2CH_3$], hexylidene-1,1-diphosphonic[$A=>CH(CH_2)_4CH_3$], 1-hydroxypropylidene-1,1-diphosphonic[$A=>C(OH)CH_2CH_3$], 1,4-dihydroxy-1,4-dimethyltetramethylene-1,4-diphosphonic

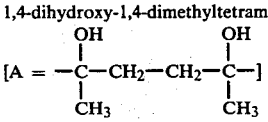

1,2,3-tributyloctylidene-1, 1-diphosponic ou 1,2,3,4-tetrabutylbutylidene-1,1-diphosphonic

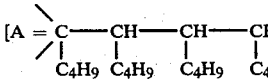

, 4-hydroxy-octylidene-1,1-diphosphonic or 4-hydroxy-6-ethylhexylidene-1,1-

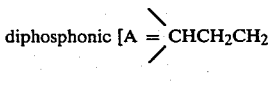

diphosphonic [A = $CHCH_2CH_2CHCH_2CH_2$], 1,3-dihydroxy-2-ethylhexamethylene-1,6-diphosphonic [A =

-continued

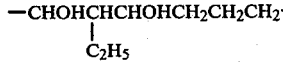

1-ethyl-3-hydroxy-hexamethylene-

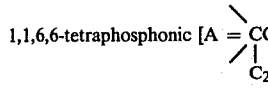

1,1,6,6-tetraphosphonic [A = $CCH_2CHOH(CH_2)_2CH(PO_3H_2)_2$], 1,4-dihydroxytetramethylene-1,1,4-triphosphonic

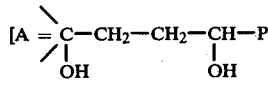

[A = $C-CH_2-CH_2-CH-PO_3H_2$], 1,3-dihydroxyhexamethylene

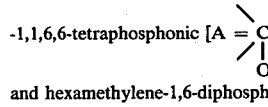

-1,1,6,6-tetraphosphonic [A = $C-CH_2CH(CH_2)_2CH(PO_3H_2)_2$]

and hexamethylene-1,6-diphosphonic [A = $-(CH_2)_6-$] acids.

Alkylenephosphonic acids answering to the aforesaid formulae II to VI may be chemically pure substances or technical products normally manufactured industrially and commercialized in liquid, paste or powder form, or even in aqueous solution form at any concentration, without the choice of one of these forms in any way constituting a restriction to the invention. In general, for commercial reasons and for convenience's sake, the alkylenephosphonic acids commercialized in aqueous solution forms are preferred.

Advantageously, the composition according to the invention will contain (a) 5 to 80 parts by weight of polyamine I and (b) 20 to 95 parts by weight of the alkylenephosphonic acid derivative and, preferably (a) 15 to 70 parts by weight of polyamine I and (b) 30 to 85 parts by weight of derivative of the alkylenephosphonic acid of formulae II to VI.

The method for preparing the anti-corrosion composition is performed in a manner known per se which consists in mixing one or more polyamines I with one or more derivatives of alkylenephosphonic acid.

According to the best mode which is recommended, the method used is characterized in that the polyamine or polyamines selected is/are brought to a liquid state by adequate heating, and then introduced progressively whilst slightly or strongly stirred, depending on the case, in an aqueous solution of the alkylenephosphonic acid(s), selected, heated beforehand to a temperature less than that of the polyamine.

Depending on the nature of the means a and b which are used, the resulting mixture may be in gel, or paste or wax form.

In practice, the polyamine(s) will be melted at a temperature varying between 30° and 85° C. approximately, and then poured into the alkylenephosphonic acid(s) brought to a temperature varying between 15° and 60° C.

It is easy to understand that when metallic surfaces needing protection have a low temperature, and more precisely temperatures below 60° C., such as the metallic surfaces of damp-air blowers, condensers, iced water system, it will be preferred to use those, amongst the alkylenephosphonic acids answering to the general formulae (II) to (VI) above, and those amongst the aliphatic polyamines answering to the general formula (I) above, which, when mixed, give compositions with as low a softening point as possible. In the same way, mixtures, with higher softening points will be preferred as anti-corrosion agents for metallic surfaces subjected to high temperatures, such as for example those found in steam boiler tubes or superheater tubes, or else those found in the cooling circuits of furnaces used in metallurgy and siderurgy.

For practical reasons and especially because most of the alkylenephosphonic acids are only available in the trade as more or less concentrated aqueous solutions, it is not economically advisable to eliminate the water from the composition according to the invention, since said composition is precisely intended to be re-dispersed in water when used as an anti-corrosion agent. Moreover, since the said water has no reaction with any of the constituents of the composition according to the invention, and since it has obviously no effect on the anti-corrosion properties thereof, its sole purpose is that of a dispersion medium for the said composition, depending on the commercial aspect that is proposed for it. Also, the very variable quantities of water that can contain the said composition could not constitute any form of limitation for the present invention.

The paste or gel compositions, produced according to the invention can be introduced, by means of a conventional volumetric piston pump, either as they stand in the water of the industrial or private building systems requiring protection, or dispersed in a larger quantity of water using one or more surface active substances found on the market and known to any one skilled in the art as capable of dispersing fatty polyamines. The quantities of substances with surface-active properties used to this effect are dependent on the commercial aspect wanted for such dispersions and could not in any way constitute a restriction of the present invention.

Besides the preferred application according to the invention indicated hereinabove, there is another anti-corrosion application whereby the metallic pieces to be protected are treated, for example by immersion, with an anticorrosion composition according to the invention, which composition can take the form of an aqueous bath, if necessary.

By way of indication, the substances with surface-active properties mostly recommended are those included preferably in the group of non-ionic and/or cationic surface-active agents. For example, suitable non-ionic substances are ethoxylated or propoxylated fatty acids and alcohols, ethoxylated fatty monoamines, esters of fatty acids or alcohols, aliphatic amine oxides, sorbitol esters, etc. and suitable, so-called cationic substances are amines salts, quaternary ammonium salts, products resulting from the condensation of ethylene oxide or propylene oxide with fatty polyamines.

Stable dispersions in water may be obtained for example with industrial products selected from those known under the trademarks: NORAMOX, ETHOMEEN, DINORAMOX, ETHODUOMEEN, ETHOQUAD, ARQUAD, NORAMIUM, NOXAMINE, ADOGEN, ELFAPUR, AROMOX, etc.

Other advantages and characteristics of the present invention will become evident from the following examples of preparation given by way of illustration and non-restrictively.

EXAMPLE 1

In a container made of glass or any other material not risking to be attacked by acids, 500 g of an aqueous solution of 40% by weight of aminotri(methylenephosphonic) acid containing 200 g anhydrous aminomethylenephosphonic) acid, answering to the general formula (II) given above, are brought to a homogeneous temperature of about 30° C. In the tepid acid solution, placed under mild mechanical stirring, are added progressively 500 g of oleylamino-propyleneamine, of technical industrial quality, answering to the general formula (I) given above, liquefied beforehand and kept, during introduction, at a temperature of about 45° C.

A thick paste of a yellow amber color is quickly obtained.

The resulting paste composition, whose solubility is less than 1% by weight in distilled water, is an excellent anti-corrosion agent according to the invention, as will be seen hereinafter.

EXAMPLE 2

Using the method given in example 1, 800 g of an aqueous solution of 30% by weight of pentapropoxypropylaminodi-(methylenephosphonic) acid, i.e. containing 240 g of the said aminophosphonic acid answering to the general formula (V) above, are heated to 40° C. whilst placed under mild mechanical stirring. Then 243 g of stearyltri(aminopropylene)amine of formula $$C_{18}H_{37}\text{-}[NH-(CH_2)_3]_3NH_2$$

heated beforehand and kept at a temperature of 50° C., are slowly added to the acid solution.

When the mixture has cooled down to room temperature, i.e. around 20° C., a cream white gel is obtained which, upon examination, reveals itself to be a very fine emulsion of a normally water-insoluble phase. A more thorough examination of the organic phase dispersed shows that its solubility in water is less than 1% by weight. Said dispersed phase constitutes an excellent anti-corrosion agent according to the invention, as shown in the results given hereinafter.

EXAMPLE 3

In a container made of glass or of stainless steel of a 1-liter capacity, are introduced, at a room temperature of 20° C., 600 g of a solution of 50% by weight of hexamethylenediaminotetra(methylenephosphonic) acid, answering to the general formula (III) given above, as well as a stainless steel stirrer capable to stir the acid solution vigourously. Also, 300 g of octadecenyltetra(aminopropylene)amine answering to the general formula (I) given above are brought to a liquid state by slow heating at about 35° C., and added progressively to the acid solution still under strong stirring. When all the polyamine has been introduced, the stirring is progressively reduced. The paste obtained after a return to room temperature, appears, when thorougly examined, as a reverse dispersion of water in a yellow amber organic phase, which is found to have but a very low degree of solubility in water. Such composition is an excellent anti-corrosion agent as the experiments described hereinafter have proved.

EXAMPLE 4

In a container made of glass or of any other material not risking to be attacked by acids, 500 g of an aqueous solution of 60% by weight of hexylidene-1,1-diphosphonic acid, containing 300 g of hexylidene-1,1-diphosphonc acid answering to the formula VI given above, are brought to a homogeneous temperature of about 35° C. To the acid solution, under strong stirring, are added progressively 250 g of oleyltri(amino-propylene)amine, of industrial quality, answering to the general formula I given above, and liquefied beforehand at a temperature of about 40° C.

A homogeneous gel of yellow amber color is instantly obtained, which gel has a very small degree of solubility in water, but despite this fact, constitutes an excellent anti-corrosion agent for steel, copper, and aluminium in the presence of water.

EXAMPLE 5

In a container made of glass or stainless steel, are introduced, at a room temperature, 400 g of an aqueous solution of 62% by weight of 1-hydroxy-1,1-ethylidenediphosphonic acid, answering to the general formula VI given above, whilst slightly stirred. 200 g of octadecenyltetra-(aminopropylene)amine, liquefied beforehand at a temperature of 55° C. are added progressively in small quantities. The resulting dispersion looks as a gelled and milky emulsion, with very little water-solubility, but with remarkable properties as an anti-corrosion agent for metals in the presence of water, as illustrated hereinafter.

EXAMPLE 6

In the same conditions as those of Example 5, 700 g of crystallized 1-hydroxy-1,1-ethylidene-diphosphonic acid found in the trade are dissolved in 500 ml of water heated to 50° C. approximately, in order to obtain a solution of the said acid at 58.33% by weight. When the whole quantity of acid has properly dissolved, 600 g of oleylaminopropyleneamine such as found on the market and liquefied beforehand in homogeneous manner at about 30° C. are added progressively whilst strongly stirred, and stirring is continued until a homogeneous paste is obtained showing no longer any separation of the aqueous phase when the mixture is cooled down to room temperature. When the said paste, whose color varies from dark yellow to brown (depending on the industrial origin of the polyamine used) is immersed in water, it proves to be virtually insoluble; nevertheless it shows excellent anti-corrosion properties for metals.

In order to show the remarkable anti-corrosion powers of the compositions according to the invention, corrosion tests have been carried out with and without the said compositions. To do this, a single experimental circuit has been built, which is capable of reproducing as faithfully as possible the conditions prevailing in industrial heating or cooling systems.

The circuit, which is mainly made of glass, with a total capacity of 19.6 liters, and topped with an expansion vessel open at the top, also made of glass and with a contents capacity of 5 liters, is provided with an adjustable draining tap, that may be used discontinuously for heating tests and continuously for cooling tests. The flow rate of 1.6 m 3/hr is ensured by a centrifugal pump (for example one such as manufactured by the company HALBERG GmbH of Ludwigshafen, West Germany) and is controlled with a rotameter. The straight portions of the circuit are tubes of industrial glass, whose diameter is 40 mm and whose total length is 3 meters. The flowing speed of the water is about 1.5 meters per second. Electrical flexible elements, wound on the straight portions ensure that the temperature is kept at any desired value by means of a control device. Moreover, in order to reproduce the effect of various metals found in industrial systems, two series of tubes in lead and copper, about 15 cm long, as well as three constantly open lead valves, have been placed in the circuit.

Said circuit further comprises means for controlling the efficiency of the inhibitors:

- test pieces in different metals for measuring the weight losses and for visual examinations,
- a double probe connected to an electronic analyzer of the CORRATER type (commercialized by the company MAGNE INSTRUMENTS ROHRBACK CORP. of Santa Fé Springs, Ca.), provided with a recorder for potentio-static measurements of corrosion speed, and with a converter for alternatively measuring the so-called "generalized" corrosion and the corrosion known as "pitting". The specific electrodes of the potentio-static CORRATER analyzer have the references 60814-8001 for measurements effected on steel, 60814-8061 for measurements effected on copper, and 60814-8080 for measurements effected on aluminium.

The test pieces for measuring the weight losses are cylinder-shaped and hollow, 50 mm long, with an outer diameter of 21.3 to 22 mm, and an inner diameter of 14.8 to 17 mm, and with an external surface of 33.45 to 34.55 cm2, in contact with the attacking medium, and weighing in average 72.5 g for the steel pieces, 69 g for the copper pieces and 21.2 g for the aluminium pieces.

Before the tests, the metal pieces are polished with a mild abrasive normally found on the market, washed in distilled water, dried in ketone and weighed with accuracy at $\pm 1\times 10^{-4}$ g. They are then mounted in series, three by three, each of a different metal, at a distance from one another and held together in position by an appropriate system in Teflon, and then introduced horizontally in a straight glass portion of the circuit. After the tests, they are removed from the circuit, brushed with a soft brush to remove all corrosion products, and washed in distilled water, dried in ketone and weighed very accurately at $\pm 1\times 10^{-4}$ g.

The anti-corrosion properties of the compositions tested were controlled by:

- weekly analyses of the circuit water;
- 1 daily dosage of the inhibitor content of the water;
- measurements of weight losses of the metal test pieces;
- potentio-static measurements of the speeds of corrosion on the electrodes of the CORRATER apparatus;
- visual examination of the metallic elements of the circuit proper.

The tests were carried out with four different varieties of water, namely tap water (tap water A1 for the anti-corrosion compositions of Examples 1–3, and tap water A2 for the anti-corrosion compositions of Examples 4–6) and soft water (soft water B1 for the anti-corrosion compositions of Examples 1–3, and soft water B2 for the anti-corrosion compositions of Examples 4–6), the soft waters B1 and B2, respectively, being obtained from the tap waters A1 and A2 respectively by passage over a ion-exchanging resin, of the cationic type in sodium cycle.

The characteristics of the waters A1 and B1, on the one hand, and of the waters A2 and B2, on the other, are given hereinafter in Table I.

Tap waters A1 and A2 (drinkable waters distributed by the city of PARIS) were used as they are for corrosion tests of the "cold" type and soft waters B1 and B2 were used for the corrosion tests of the "heat" type.

TABLE I

| CHARACTERISTICS | Tap water A1 (a) | Soft water B1 (a) (b) | Tap Water A2 (c) | Soft Water B2 (c) (d) |
|---|---|---|---|---|
| pH | 7.3 to 20° C. | 7.3 to 20° C. | 7.2 to 20° C. | 7.2 to 20° C. |
| Hydrotimetric titer | 28° French | 0.1° French | 25° French | 0.1° French |
| Alkalimetric titer AT | 0° | 0 | 0° | 0° |
| Full alkalimetric titer FAT | 22° French | 22° French | 20° French | 20° French |
| Strong acids titer (SAT) | 2.4° French | 2.4° French | 2° French | 2° French |
| Chloride (in $Cl^-$) | 15 mg/l | 15 mg/l | 18 mg/l | 18 mg/l |
| Sulphates (in $SO_4^{--}$) | 4 mg/l | 4 mg/l | 2 mg/l | 2 mg/l |
| Iron | 0.06 mg/l | (e) | (e) | (e) |
| Oxygen | 8 mg/l | Saturation | 8 mg/l | saturation |

Notes
(a) for anti-corrosion compositions of Examples 1-3
(b) obtained from tap water A1,
(c) for anti-corrosion compositions of Examples 4-6
(d) obtained from tap water A2
(e) less than 0.06 mg/l Due to the presence of dissolved oxygen, soft waters are known to be very aggressive as proved by the losses of thickness observed in the control pieces during the control tests reported hereinafter in TABLES II to V.

In order to make it easier to read the following Tables II to IX, the results have been directly converted into loss of thickness, expressed in microns per annum., and deducted from the weight losses that have been measured, using the following formula:

$$\text{Corrosion in microns per annum.} = \frac{P \times 365}{10 \times J \times S \times d}$$

wherein:

P=loss of weight given in milligrammes
J=number of days of exposure in attacking medium
S=external surface of the test piece given in cm2
d=specific mass of the metal of the test piece given in g/cm3.

The percentages of corrosion calculated from the said losses of thickness have also been given, the control showing a corrosion percentage of 100%.

CORROSION TESTS OF THE "HEAT" TYPE

The results obtained in the corrosion tests of the "HEAT" type, are given hereinafter in Tables II to V. Tables II and III relate to the measurements of weight losses, and Tables IV and V to the potentiostatic measurements for assessing the speeds of corrosion (expressed in microns per annum).

In order not to immobilize the circuit too long, the control measurements, i.e. measurements without inhibitor, were carried out for only 15 days, whereas the measurements in the presence of the inhibitor, where carried out for two months, for each composition tested and at two different dosages, within an approximate ratio of 10 to 1, depending on the mechanical possibilities of dispersion in the water of the compositions of Examples 1 to 6 above, without a surface-active agent having been used.

TABLE II

"HEAT" type corrosion tests
Measurement of weight losses. Temperature: 58° C.
Soft water B1
Duration: 2 months (60 days); Control = 15 days

| INHIBITOR | | CORROSION | | | | | |
|---|---|---|---|---|---|---|---|
| Nature | Dose in ppm | STEEL μ/ann. | STEEL % | COPPER μ/ann. | COPPER % | ALUMINIUM μ/ann. | ALUMINIUM % |
| Control | 0 | 217.10 | 100 | 35.25 | 100 | 49.50 | 100 |
| Example 1 | 120 | 11.53 | 5.3 | 2.03 | 5.8 | 0.51 | 1.0 |
| | 10 | 21.17 | 9.8 | 4.88 | 13.9 | 1.64 | 3.3 |
| Example 2 | 98 | 12.45 | 5.7 | 3.66 | 10.4 | 0.70 | 1.1 |
| | 8 | 25.10 | 11.6 | 5.37 | 15.2 | 1.80 | 3.6 |
| Example 3 | 55 | 11.21 | 5.2 | 0.34 | 1.0 | 0.15 | 0.3 |
| | 14 | 21.50 | 9.9 | 0.75 | 2.1 | 0.64 | 1.3 |

TABLE III

"HEAT" type Corrosion tests
Measurement of weight losses. Temperature: 58° C.
Soft water B2
Duration: 2 months (60 days); Control: 15 days

| INHIBITOR | | CORROSION | | | | | |
|---|---|---|---|---|---|---|---|
| NATURE | Dose in ppm | STEEL μ/ann. | STEEL % | COPPER μ/ann. | COPPER % | ALUMINIUM μ/ann. | ALUMINIUM % |
| CONTROL | 0 | 226.75 | 100 | 45.12 | 100 | 61.55 | 100 |
| EXAMPLE 4 | 95 | 17.2 | 7.6 | 0.8 | 1.8 | 4.1 | 6.7 |
| | 10 | 40.1 | 17.7 | 5.1 | 11.3 | 18.2 | 29.6 |
| EXAMPLE 5 | 145 | 15.1 | 6.7 | 0.5 | 1.1 | 3.5 | 5.7 |
| | 14 | 38.2 | 16.8 | 4.5 | 10.0 | 15.1 | 24.5 |
| EXAMPLE 6 | 82 | 30.5 | 13.5 | 2.0 | 4.4 | 8.6 | 14.0 |
| | 7 | 42.0 | 18.5 | 5.5 | 12.2 | 18.6 | 30.2 |

Long lasting tests, e.g. 60 days, which are preferably carried out in the presence of the non-stoichiometric anti-corrosion compositions according to the present invention, do not permit intermediate measurements of weight losses which would require frequent and thus unreliable handlings, For this reason, the potentio-static measurements of speed of corrosion were carried out jointly and their recording has given quite comparable results indictated hereunder in Tables IV and V.

TABLE IV

"HEAT" type corrosion tests
"CORRATER" potentio-static measurements. Temperature: 58° C.
Soft water: B1. Duration: 2 months (60 days); Control: 15 days

| INHIBITOR | | CORROSION | | | | | |
|---|---|---|---|---|---|---|---|
| NA- | Dose | STEEL | | COPPER | | ALUMINIUM | |
| TURE | in ppm | μ/ann | % | μ/ann. | % | μ/ann. | % |
| CON-TROL | 0 | 200 | 100 | 30 | 100 | 32 | 100 |
| EX- | 120 | 12 | 6.0 | 2 | 6.7 | 1 | 3.13 |
| AM- | 10 | 23 | 11.5 | 5 | 16.7 | 1 | 3.13 |
| PLE 1 | | | | | | | |
| EX- | 98 | 13 | 6.5 | 4 | 13.3 | 0 | 0 |
| AM- | 8 | 38 | 19.0 | 6 | 20.0 | 0 | 0 |
| PLE 2 | | | | | | | |
| EX- | 55 | 10 | 5.0 | 0.5 | 1.7 | 0 | 0 |
| AM- | 14 | 20 | 10.0 | 1 | 3.3 | 0 | 0 |
| PLE 3 | | | | | | | |

TABLE V

"HEAT" type corrosion tests.
"CORRATER" potentio-static measurements. Temperature: 58° C.
Soft water:B2 Duration: 2 months (60 days); Control: 15 days

| INHIBITOR | | CORROSION | | | | | |
|---|---|---|---|---|---|---|---|
| NA- | Dose | STEEL | | COPPER | | ALUMINIUM | |
| TURE | in ppm | μ/ann. | % | μ/ann. | % | μ/ann. | % |
| CON-TROL | 0 | 218 | 100 | 41 | 100 | 58 | 100 |
| EX- | | | | | | | |
| AM- | 95 | 20 | 9.2 | 1 | 2.4 | 4 | 6.9 |
| PLE 4 | 10 | 40 | 18.3 | 5 | 12.2 | 20 | 34.5 |
| EX- | | | | | | | |
| AM- | 145 | 15 | 6.9 | 0 | 0 | 0 | 0 |
| PLE 5 | 14 | 30 | 13.8 | 5 | 12.2 | 15 | 25.9 |
| EX- | | | | | | | |
| AM- | 82 | 30 | 13.8 | 0 | 0 | 5 | 8.6 |
| PLE 6 | 7 | 40 | 18.3 | 6 | 14.6 | 20 | 34.5 |

At the end of tests, microscope examination shows that all the test pieces are free of "pitting" which appears to be normal since the "CORRATER" switched to "pitting+corrosion" gave readings identical to ±5 microns per annum. The steel test pieces stayed very smooth but non shiny, of a slightly brownish color. The copper and aluminium pieces, in every case retained their shiny surfaces with no alteration noticeable under the microscope. The other metallic elements of the circuit appear to be intact, with no deposit or corrosion.

"COLD" type corrosion tests

For the "cold" type tests, the circuit has been modified by the introduction into its straight portion of a hollow steel probe, of 240 mm long and with an outside diameter of 28 mm, provided with a heating element which is adjustable by way of the rheostat.

The metal test pieces for measuring the weight losses and the "CORRATER" probe are retained, as with the "HEAT" type tests. The circuit is filled and then supplied continuously with tap water from the city of PARIS, having the characteristics indicated in TABLE I and at the rate of about 20 liters per hour, entailing the renewing of the circuit water every hour in average. The drainage is controlled continuously so that the water level in the expansion vessel is kept constant. The anti-corrosion paste, according to the compositions of the invention is simply immersed in the expansion vessel by means of a linen bag. The temperature of the water, kept in forced circulation by the centrifugal pump and measured by a thermometer placed upstream of the heated probe, is stabilized at 50° C.±5° C.

Each test lasts 15 days with or without the inhibitors of Examples 1 to 6 above. The same measurements are carried out as for the "HEAT" type tests, with the only difference that at the end of the tests, the cylindrical test pieces in steel, copper and aluminium, as well as the heated probe made of steel, are washed before being brushed, with a diluted solution of passivated sulfamic acid, before removing any possible deposits of mineral salts that could be due to the hardness of the tap water and which the phosphonic acids, present in possibly insufficient quantities in the compositions according to the invention, could not have prevented.

The results are given hereinafter in Tables VI to IX. Tables VI and VII relate to the measurement of weight losses and Tables VIII and IX to potentiostatic measurements for assessing the speeds of corrosion.

TABLE VI

"COLD" type corrosion test
Measurements in weight losses. Temperature = 50° C.
Tap water A1
Duration: 15 days

| Inhibitor | | CORROSION | | | | | |
|---|---|---|---|---|---|---|---|
| NA- | Dose | STEEL | | COPPER | | ALUMINIUM | |
| TURE | in ppm | μ/ann. | % | μ/ann. | % | μ/ann. | % |
| CON-TROL | 0 | 154 | 100 | 25.5 | 100 | 44.5 | 100 |
| EX- | | | | | | | |
| AM- | 35 | 7.41 | 4.8 | 0.82 | 3.2 | 0.15 | 0.34 |
| PLE 1 | 5 | 12.17 | 7.9 | 1.33 | 5.2 | 0.87 | 1.96 |
| EX- | | | | | | | |
| AM- | 42 | 12.19 | 7.9 | 1.16 | 4.5 | 0.15 | 0.34 |
| PLE 2 | 7 | 17.04 | 11.1 | 1.30 | 5.1 | 0.95 | 2.13 |
| EX- | | | | | | | |
| AM- | 25 | 6.77 | 4.4 | 0.88 | 3.5 | 0 | 0 |
| PLE 3 | 5 | 8.15 | 5.3 | 1.04 | 4.1 | 0 | 0 |

TABLE VII

"COLD" Type corrosion test
Measurements of weight losses. Temperature = 50° C.
Tap water A2
Duration: 15 days

| INHIBITOR | | CORROSION | | | | | |
|---|---|---|---|---|---|---|---|
| NA- | Dose | STEEL | | COPPER | | ALUMINIUM | |
| TURE | in ppm | μ/ann. | % | μ/ann. | % | μ/ann. | % |
| CON-TROL | 0 | 163.5 | 100 | 28.2 | 100 | 43.6 | 100 |
| EX- | | | | | | | |
| AM- | 48 | 8.8 | 5.4 | 1.1 | 3.9 | 0.6 | 1.4 |
| PLE 4 | 5 | 21.5 | 13.1 | 2.3 | 8.2 | 1.2 | 2.8 |
| EX- | | | | | | | |
| AM- | 65 | 7.0 | 4.3 | 0.9 | 3.2 | 0.6 | 1.4 |
| PLE 5 | 8 | 20.5 | 12.5 | 2.2 | 7.8 | 0.8 | 1.8 |
| EX- | | | | | | | |
| AM- | 38 | 10.1 | 6.2 | 2.0 | 7.1 | 1.1 | 2.5 |
| PLE 6 | 4 | 28.8 | 17.6 | 5.2 | 18.4 | 3.8 | 8.7 |

The potentio-static measurements effected simultaneously with the CORRATER electronic analyzer, give values that are quite comparable to those obtained from the measurements of weight losses, as shown hereinafter in Tables VIII and IX.

TABLE VIII

"COLD" type corrosion tests.
"CORRATER" potentio-static measurements. Temperature: 50° C. Tap water A1
Duration: 15 days.

| INHIBITOR | | CORROSION | | | | | |
|---|---|---|---|---|---|---|---|
| | | STEEL | | COPPER | | ALUMINIUM | |
| NATURE | Dose in ppm | μ/ann. | % | μ/ann. | % | μ/ann. | % |
| CONTROL | 0 | 160 | 100 | 25 | 100 | 50 | 100 |
| EXAMPLE 1 | 35 | 18 | 11.3 | 0 | 0 | 0 | 0 |
| | 5 | 15 | 9.4 | 0 | 0 | 0 | 0 |
| EXAMPLE 2 | 42 | 16 | 10.0 | 0 | 0 | 0 | 0 |
| | 7 | 22 | 13.8 | 0 | 0 | 0 | 0 |
| EXAMPLE 3 | 25 | 5 | 3.1 | 0 | 0 | 0 | 0 |
| | 5 | 10 | 6.3 | 0 | 0 | 0 | 0 |

TABLE IX

"COLD" Type corrosion tests.
"CORRATER" potentio-static measurements. Temperature: 50° C. Tap water A2
Duration: 15 days.

| INHIBITOR | | CORROSION | | | | | |
|---|---|---|---|---|---|---|---|
| | | STEEL | | COPPER | | ALUMINIUM | |
| NATURE | Dose in ppm | μ /ann. | % | μ /ann. | % | μ /ann. | % |
| CONTROL | 0 | 172 | 100 | 33 | 100 | 40 | 100 |
| EXAMPLE 4 | 48 | 10 | 5.8 | 0 | 0 | 0 | 0 |
| | 5 | 20 | 11.6 | 3 | 9.1 | 0 | 0 |
| EXAMPLE 5 | 65 | 8 | 4.7 | 0 | 0 | 0 | 0 |
| | 8 | 20 | 11.6 | 2 | 6.1 | 0 | 0 |
| EXAMPLE 6 | 38 | 10 | 5.8 | 2 | 6.1 | 1 | 2.5 |
| | 4 | 30 | 17.4 | 5 | 15.2 | 4 | 10.0 |

At the end of the tests, most of the test pieces as well as the heated probe, appear to be coated with a very fine white powder which is removed easily with a soft brush, even from the heated probe. A rince in diluted sulfamic acid is nevertheless done as a precaution measure.

A microscope examination shows that all the test pieces and the heated probe are completely pitting-free. The steel test-pieces are smooth, of a brownish color, more pronounced than on the heated probe. The copper and aluminium test pieces are a little less shiny than in the "HEAT" type tests. The other metallic elements of the circuit appear after dismantling, brushing and rincing in sulfamic acid, totally free of any deposits of corrosion and of any visible corroding.

All the results given in Tables II to IX show the remarkable anti-corrosion properties of the compositions according to the invention, since no corrosion was ever equal to or greater than 50 microns per annum for steel, 7 microns per annum for copper and 20 microns per annum for aluminium, with the compositions of Examples 4 to 6. The results obtained with the compositions of Examples 1 to 3 are better in that no corrosion was ever equal to or greater than 40 microns per annum for steel, 7 microns per annum for copper and 2 microns per annum for aluminium.

Examples 1 to 6 and Tables II to IX also show that important variations in the nature and respective proportions of the constituants of the compositions according to the invention have no significant effect on the anti-corrosion properties thereof. It is also a remarkable fact that the compositions according to the invention require no adjustment of the pH of the corrosive medium nor the addition of specific inhibitors, for copper for example. It is finally remarkable that in doses of 5 parts per one million, the compositions according to the invention show an anti-corrosion power that is clearly greater than the anti-corrosion powers of each of their constituents, taken separately, in substantially higher doses.

What is claimed is:

1. An anti-corrosion composition for a metallic surface in contact with water comprising at least a polyamine and at least an alkylene-phosphonic acid derivative, which composition is water-insoluble and contains:

(A) at least a polyamine with a molecular weight at least 320 and having the general formula $$R—[NM—(CH_2)_3]_{n1}—NH_2 \quad (I)$$

wherein R is a saturated or unsaturated aliphatic $C_{12}$–$C_{22}$ hydrocarbon radical; and $n_1$ is an integer varying between 1 and 7 inclusive, R and $n_1$ being such that the molecular weight of the said polyamine is at least 320; and (B) at least one alkylenephosphonic acid derivative selected from the group consisting of (a) (i) the acids of formula

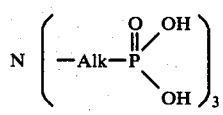

(II)

wherein alk is an alkylene group containing $C_1$–$C_6$ and a straight or branched hydrocarbon chain, and (ii) their $C_1$–$C_4$ alkyl esters;

(b) (i) the acids of formula $$(H_2O_3P—CH_2)_2N—(CH_2)_{n2}—N(CH_2—PO_3H_2)_2 \quad (III)$$

wherein $n_2$ is an integer varying between 1 and 6 inclusive; and (ii) their $C_1$–$C_4$ alkyl esters;

(c) (i) -di(hydroxyethyl)aminomethylphosphonic acid of formula $$(HO—CH_2CH_2)_2N—CH_2—PO_3H_2 \quad (IV)$$

(ii) its $C_1$–$C_4$ alkyl esters; and (d) (i) acids of formula $$Z^1—O—(Z^2—O)_{n3}—Z^3—N[(CH_2)_{n4}—PO_3H_2]_2 \quad (V)$$

wherein $Z^1$ is H or an $C_1$–$C_5$ alkyl group; $Z^2$ is a $C_2$–$C_5$ alkylene group; $Z^3$ is a $C_2$–$C_5$ alkylene group; $n_3$ is an integer varying between 1 and 20 inclusive, and $n_4$ is an integer varying between 1 and 4, and (ii) their $C_1$–$C_4$ alkyl esters.

2. An anti-corrosion composition of claim 1, wherein the alkenephosphonic acid derivative is a compound selected from the group consisting of the alkylenepolyphosphonic acids comprising at least two $PO_3H_2$ functions.

3. A composition of claim 1, wherein the alkylenepolyphosphonic acid derivative has the general formula

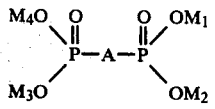

(VI)

wherein A is a bivalent alkylene group comprising a straight and saturated $C_1$–$C_{10}$ hydrocarbon chain, each carbon atom of which chain may be, substituted by at least a group selected from the OH, $C_1$–$C_4$-alkyl and phosphonic groups having the formula

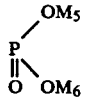

and $M_1$, $R_2$, $M_3$, $M_4$, $M_5$ and $M_6$, whether identical or different, are each H, a $C_1$–$C_6$ alkyl group, $NH_4^+$ a metal cation.

4. A composition of claim 3, wherein the alkylenepolyphosphonic acid derivative is an acid of formula VI wherein $M_1$=$M_2$=$M_3$=$M_4$=$M_6$=$M_6$=H.

5. A composition of claim 1 comprising:

(a) 50 to 80parts by weight of polyamine I; and (b) 20 to 95 parts by weight of alkylenephosphonic acid derivative.

6. A composition of claim 1 comprising:

(a) 15 to 70 parts by weight of polyamine I, and (b) 30 to 85 parts by weight of alkylenephosphonic acid derivative.

7. A composition of any one of claims 1, 5 or 6 which is the form of a suspension or dispersion in water and further comprising a surface-active agent.

8. A process for the preparation of an anti-corrosion composition of claim 1 consisting of introducing the polyamine I in an aqueous soluion of the alkenephosphonic acid derivative, the temperature of said derivative in aqueous solution being less than that of the polyamine I.

* * * * *

UNITED STATES PATENT AND TRADEMARK OFFICE

CERTIFICATE OF CORRECTION

PATENT NO. : 4,276,089

DATED : June 30, 1981

INVENTOR(S) : Francis Moran

It is certified that error appears in the above-identified patent and that said Letters Patent are hereby corrected as shown below:

Column 16, line 16, "[NM" should read -- [NH --;

line 56, "$C_2$ -$C_5$" should read -- $C_3$ -$C_5$ --;
line 61, "alkenephosphonic" second occurrence should read -- alkylenephosphonic --.

Column 17, line 19, "$R_2$" should read -- $M_2$ --;
line 20, "$C_1$ -$C_6$" should read -- $C_1$ -$C_4$ --;
line ~~30~~ 20, after "$NH_4^+$", insert -- or --.

Column 18, line 3, "$M_6$" (first occurrence) should read -- $M_5$ --;
line 5, "50" should read -- 5 --;
line 17, "soluion" should read -- solution-- and "alkenephos-" should read -- alkylenephos- .

Signed and Sealed this

Twentieth Day of October 1981

[SEAL]

Attest:

GERALD J. MOSSINGHOFF

Attesting Officer

Commissioner of Patents and Trademarks